US010354675B2

(12) United States Patent
Hashimoto et al.

(10) Patent No.: US 10,354,675 B2
(45) Date of Patent: Jul. 16, 2019

(54) SIGNAL PROCESSING DEVICE AND SIGNAL PROCESSING METHOD FOR INTERPOLATING A HIGH BAND COMPONENT OF AN AUDIO SIGNAL

(71) Applicant: Clarion Co., Ltd., Saitama-shi (JP)

(72) Inventors: Takeshi Hashimoto, Motomiya (JP); Tetsuo Watanabe, Hasuda (JP); Yasuhiro Fujita, Kashiwa (JP); Kazutomo Fukue, Saitama (JP); Takatomi Kumagai, Saitama (JP)

(73) Assignee: CLARION CO., LTD., Saitama (JP)

( * ) Notice: Subject to any disclaimer, the term of this patent is extended or adjusted under 35 U.S.C. 154(b) by 32 days.

(21) Appl. No.: 15/322,194

(22) PCT Filed: Jun. 22, 2015

(86) PCT No.: PCT/JP2015/067824

§ 371 (c)(1),
(2) Date: Dec. 27, 2016

(87) PCT Pub. No.: WO2016/002551

PCT Pub. Date: Jan. 7, 2016

(65) Prior Publication Data

US 2017/0140774 A1 May 18, 2017

(30) Foreign Application Priority Data

Jul. 4, 2014 (JP) ..... 2014-138351

(51) Int. Cl.
*G10L 21/0332* (2013.01)
*G10L 21/0232* (2013.01)
*G10L 21/0388* (2013.01)

(52) U.S. Cl.
CPC ..... *G10L 21/0332* (2013.01); *G10L 21/0232* (2013.01); *G10L 21/0388* (2013.01)

(58) Field of Classification Search
CPC ..... G10L 21/0332; G10L 21/0232; G10L 21/0388
(Continued)

(56) References Cited

U.S. PATENT DOCUMENTS 7,457,757 B1 * 11/2008 McNeill ..... G10L 21/0208 704/500
7,676,043 B1 3/2010 Tsutsui et al.
(Continued)

FOREIGN PATENT DOCUMENTS

EP 2209116 A1 7/2010
EP 3007171 A1 4/2016
(Continued)

OTHER PUBLICATIONS

International Search Report and Written Opinion issued in Application No. PCT/JP2015/067824 dated Sep. 15, 2015.
(Continued)

*Primary Examiner* — Edwin S Leland, III
(74) *Attorney, Agent, or Firm* — McCarter & English, LLP

(57) ABSTRACT

There is provided a signal processing device, comprising: a frequency detecting means that detects a frequency satisfying a predetermined condition from an audio signal; an offset means that gives an offset to the detected frequency by the frequency detecting means in accordance with a frequency property at the detected frequency or around the detected frequency; a reference signal generating means that generates a reference signal by extracting a signal from the audio signal based on the detected frequency offset by the offset means; an interpolation signal generating means that generates an interpolation signal based on the generated reference signal; and a signal synthesizing means that performs
(Continued)

high band interpolation by synthesizing the generated interpolation signal and the audio signal.

4 Claims, 13 Drawing Sheets

(58) Field of Classification Search
USPC ..... 704/500
See application file for complete search history.

(56) References Cited

U.S. PATENT DOCUMENTS

| | | | | |
|---|---|---|---|---|
| 8,554,349 | B2 | 10/2013 | Hashimoto | |
| 2009/0259476 | A1 | 10/2009 | Sato | |
| 2010/0222907 | A1 | 9/2010 | Hashimoto | |
| 2010/0274564 | A1* | 10/2010 | Bakalos | G10K 11/178 704/500 |
| 2012/0016667 | A1* | 1/2012 | Gao | G10L 21/038 704/203 |
| 2014/0114147 | A1* | 4/2014 | Romesburg | A61B 5/02416 600/301 |
| 2015/0010170 | A1* | 1/2015 | Lindahl | H03H 17/0261 381/119 |
| 2016/0104499 | A1 | 4/2016 | Hashimoto et al. | |
| 2017/0077938 | A1* | 3/2017 | Heubi | H03M 1/08 |
| 2017/0140774 | A1* | 5/2017 | Hashimoto | G10L 21/0388 |

FOREIGN PATENT DOCUMENTS

| | | |
|---|---|---|
| JP | 2005010621 | 1/2005 |
| JP | 2007025480 | 2/2007 |
| JP | 2007-192964 | 8/2007 |
| WO | 2007029796 | 3/2007 |
| WO | 2009054393 | 4/2009 |
| WO | 2014192675 | 12/2014 |

OTHER PUBLICATIONS

Extended European Search Report for Application No. EP15814179.6 dated Dec. 1, 2017.
International Search Report issued in PCT/JP2015/067824 dated Sep. 15, 2015.
Notification of Reasons for Refusal issued in JP Application 2014-138351 dated Apr. 19, 2018, along with English translation.

* cited by examiner (a) (b)

SIGNAL PROCESSING DEVICE AND SIGNAL PROCESSING METHOD FOR INTERPOLATING A HIGH BAND COMPONENT OF AN AUDIO SIGNAL

RELATED APPLICATIONS

This application is a U.S. National Phase Application under 35 U.S.C. 371 of International Application No. PCT/JP2015/067824 filed Jun. 22, 2015, which claims the benefit of Japanese Patent Application No. 2014-138351 filed on Jul. 4, 2014. The disclosures of these applications are incorporated herein by reference in their entireties.

TECHNICAL FIELD

The present invention relates a signal processing device and a signal processing method for interpolating a high band component of an audio signal by generating a interpolation signal and synthesizing the interpolation signal and the audio signal.

BACKGROUND ART

As a format for compressing an audio signal, a lossy compression format, such as, MP3 (MPEG Audio Layer-3), WMA (Windows Media Audio™), and AAC (Advanced Audio Coding), is known. Regarding the lossy compression format, a high compression rate is attained by significantly cutting a high frequency component close to an upper limit of an audible band or exceeding the upper limit of the audible band. At the beginning of the period where technology of this type was developed, it was believed that, even when a high frequency component is cut significantly, sound quality in terms of auditory feeling is not deteriorated. However, in recent years, the thought that cutting significantly a high frequency component causes minute changes in sound quality and thereby sound quality in terms of auditory feeling is deteriorated in comparison with original sound has become the mainstream. In view of the circumstances, a high band interpolating, apparatus which enhances sound quality by interpolating a high band for an audio signal which has been subjected to a lossy compression. A specific configuration of a high band interpolating apparatus of this type is described, for example, in Japanese Patent Provisional Publication No. 2007-25480A (hereafter, referred to as patent document 1) and Domestic re-publication of PCI publication No. 2007-29796A1 (hereafter, referred to as patent document 2).

The high band interpolating apparatus described in the patent document 1 calculates a real part and an imaginary part of a signal obtained by analyzing an audio signal (original signal), forms an envelope component of the original signal based on the calculated real part and the imaginary part, and extracts a higher harmonic component of the formed envelope component. The high band interpolating apparatus described in the patent document 1 executes interpolation for a high band of the original signal by synthesizing the extracted higher harmonic component and the original signal.

The high band interpolating apparatus described in the patent document 2 inverts a spectrum of an audio signal, upsamples the signal of which spectrum is inverted, and extracts an expanded band component of which the lower frequency edge is approximately equal to a high band of a baseband signal based on the upsampled signal. The high band interpolating apparatus described in the patent document 2 executes interpolation for a high band of the baseband signal by synthesizing the extracted expanded band component and the baseband signal.

SUMMARY OF THE INVENTION

A frequency band of an audio signal compressed by the lossy compression varies depending on a compression encoding format, a sampling rate or a bit rate after the compression encoding. Therefore, as described in the patent document 1, when the high band interpolation is performed by synthesizing an audio signal and an interpolation signal with a fixed frequency band, a frequency spectrum of the audio signal after the high band interpolation becomes discontinuous depending on the frequency band of the audio signal before the high band interpolation. Thus, the high band interpolating apparatus described in the patent document 1 may contrarily cause deterioration of sound quality in terms of auditory feeling by subjecting the audio signal to the high band interpolation.

Although an audio signal has, as a general property, a property that a higher frequency region attenuates largely, there is a case where a level of an audio signal increases on a high frequency side momentarily. However, in the patent document 2, only the former general property of an audio signal is taken into consideration as a property of an audio signal input to the apparatus. Therefore, immediately after an audio signal having the property that a level increases on a high frequency side is input to the apparatus, the frequency spectrum of the audio signal becomes discontinuous and thereby a high band is excessively highlighted. Thus, as in the case of the high band interpolating apparatus described in the patent document 1, the high band interpolating apparatus described in the patent document 2 may contrarily cause deterioration of sound quality in terms of auditory feeling by subjecting the audio signal to the high band interpolation.

Audio signals include not only an audio signal of a lossy compression format but also an audio signal of a lossless compression format and audio signals of a CD (Compact Disc) sound source or a high resolution sound source such as DVD (Digital Versatile Disc) Audio and SACD (Super Audio CD). There is a concern that, when the technology described in the patent document 1 or the patent document 2 is applied to these audio signals, deterioration of sound quality in terms of auditory feeling is also caused contrarily by subjecting these audio signals to the high band interpolation.

The present invention is made, in view of the above described circumstances. That is, the object of the present invention is to provide a signal processing device and a signal processing method suitable for achieving enhancement of sound quality through use of high band interpolation for an audio signal.

A signal processing device according to an embodiment of the invention comprises: a frequency detecting means that detects a frequency satisfying a predetermined condition from an audio signal; an offset means that gives an offset to the detected frequency by the frequency detecting means in accordance with a frequency property at the detected frequency or around the detected frequency; a reference signal generating means that generates a reference signal by extracting a signal from the audio signal based on the detected frequency offset by the offset means; an interpolation signal generating means that generates an interpolation signal based on the generated reference signal; and a signal synthesizing means that performs high band interpolation by synthesizing the generated interpolation signal and the audio signal.

The offset means may detect a slope property of the audio signal at the detected frequency or around the detected frequency, and may change an offset amount for the detected frequency according to the detected slope property.

The offset means may set the offset amount for the detected frequency such that the offset amount becomes larger as attenuation of the audio signal at the detected frequency or around the detected frequency becomes more moderate.

The reference signal generating means may extract, from the audio signal, a signal corresponding to a range extending from the detected frequency by n % toward a lower frequency side, and generates the reference signal using the extracted signal.

The frequency detecting means may calculate a level of a first frequency region in the audio signal and a level of a second frequency region higher than the first frequency region in the audio signal, may set a threshold based on the calculated levels of the first frequency region and the second frequency region, and may detect, as the frequency satisfying the predetermined condition, a frequency of which level is lower than a level of the set threshold.

The frequency detecting means may detect, as the frequency satisfying the predetermined condition, a frequency at a frequency point which is on a highest frequency side of at least one frequency point of which level is lower than the level of the threshold.

The interpolation signal generating means may make a copy of the reference signal after performing weighting by a window function and an overlapping process for the reference signal generated by the reference signal generating means, may arrange side by side a plurality of reference signals increased by the copy to a frequency band higher than the detected frequency, and may generate the interpolation signal by executing weighting, for each frequency component of the plurality of reference signals arranged side by side, according to a frequency property of the audio signal.

The signal processing device according to an embodiment may further comprise a noise reduction means that reduces noise contained in the reference signal prior to making the copy of the reference signal by the interpolation signal generating means.

The signal processing device according to an embodiment may further comprise a filtering means that filters the audio signal. In this case, the signal synthesizing means may execute the high band interpolation for the audio signal by synthesizing the interpolation signal and the audio signal filtered by the filtering means. The filtering means may be configured such that a cutoff frequency for the audio signal is variable according to the detected frequency.

A signal processing method according to an embodiment of the invention comprises: a frequency detecting step of detecting a frequency satisfying a predetermined condition from an audio signal; an offset step of giving an offset to the detected frequency by the frequency detecting step in accordance with a frequency property at the detected frequency or around the detected frequency; a reference signal generating step of generating a reference signal by extracting a signal from the audio signal based on the detected frequency offset by the offset step; an interpolation signal generating step of generating art interpolation signal based on the generated reference signal; and a signal synthesizing step of performing high band interpolation by synthesizing the generated interpolation signal and the audio signal.

According to the embodiments of the invention, a signal processing device and a signal processing method suitable for achieving enhancement of sound quality through use of high band interpolation for an audio signal are provided.

EMBODIMENTS FOR CARRYING OUT THE INVENTION

In the following, a sound processing device 1 according to an embodiment is described with reference to the accompanying drawings.

(Overall Configuration of Sound Processing Device 1)

Figure 1:
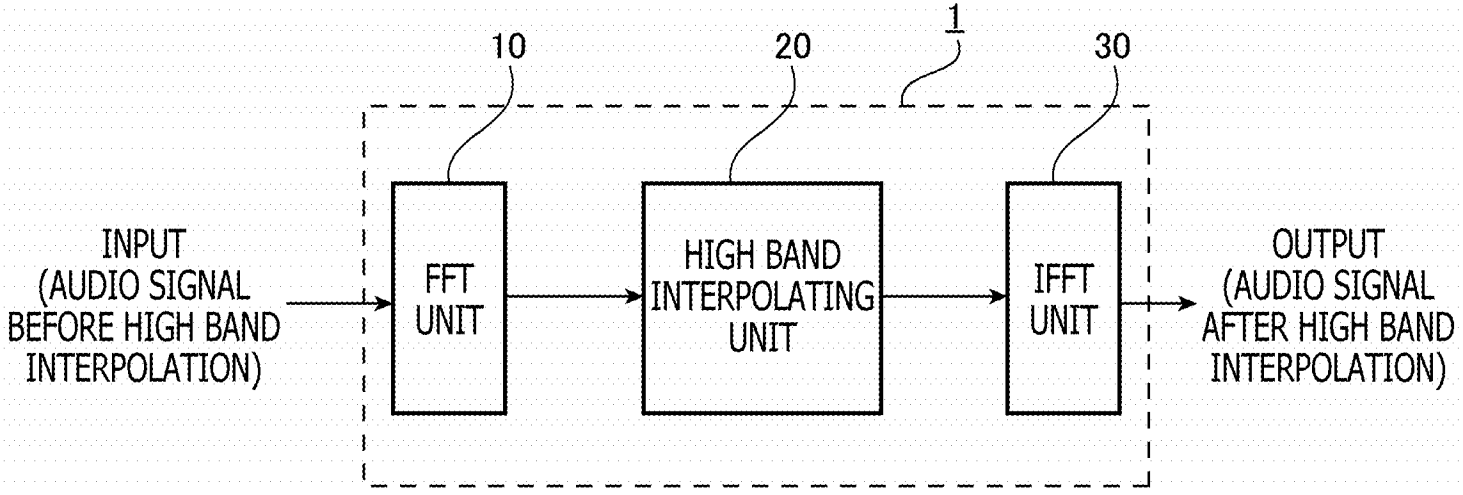
FIG. 1 is a block diagram illustrating a configuration of a sound processing device according to an embodiment of the invention.

FIG. 1 is a block diagram illustrating a configuration of the sound processing device 1 according to the embodiment. As shown in FIG. 1, the sound processing device 1 includes an FFT (Fast Fourier Transform) unit 10, a high band interpolating unit 20 and an IFFT (inverse ITT) unit 30.

To the FFT unit 10, for example, an audio signal obtained by decoding an encoded signal of a lossy compression format, an audio signal obtained by decoding an encoded signal of a lossless compression format, or an audio signal of a CD sound source or a high resolution sound source such as DVD audio and SAO) is input. The lossy compression format is, for example, MP3, WMA or AAC. The lossless compression format is, for example, WMAL (MWA Lossless), ALAC (Apple™ Lossless Audio Codec), or AAL (ATRAC Advanced Lossless™). For convenience of explanation, an audio signal of a lossy compression format is referred to as a "high compression audio signal", and an audio signal which has information on a higher frequency region than that of the high compression audio signal and which is, for example, an audio signal of a lossless compression format, an audio signal of a high resolution sound source, and an audio signal not satisfying the specifications of the high resolution sound source such as CD-DA (44.1 kHz/16 bit) is referred to as a "high quality audio signal".

The FFT unit 10 subjects the input audio signal to a overlapping process and weighting by a window function, converts the processed signal from a time domain to a frequency domain by STFT (Short-term Fourier Transform), and obtains a complex spectrum including a real number and an imaginary number to output the complex spectrum to the high hand interpolating unit 20. The high frequency interpolation processing unit 20 interpolates a high band of the complex spectrum input from the FFT unit 10 and outputs the resultant complex spectrum to the IFFT unit 30. In the case of the high compression audio signal, a hand interpolated by the high band interpolating unit 20 is, for example, a frequency band exceeding or close to the upper limit of an audible band cut significantly during processing of the lossy compression. In the case of the high quality audio signal, a band interpolated by the high band interpolating unit 20 is, for example, a frequency band which exceeds or is close to the upper limit of an audible band and which includes a band of which level attenuates moderately. The IFFT unit 30 obtains a real number and an imaginary number of the complex spectrum based on the complex spectrum of which the high band is interpolated by the high band interpolating unit 20, and executes weighting by a window function. The IFFT unit 30 executes signal conversion from the time domain to the frequency domain by executing STFT and overlapping addition for the weighted signal, and generates and outputs the audio signal of which the high band is interpolated.

(Configuration of High Band Interpolating Unit 20)

Figure 2:
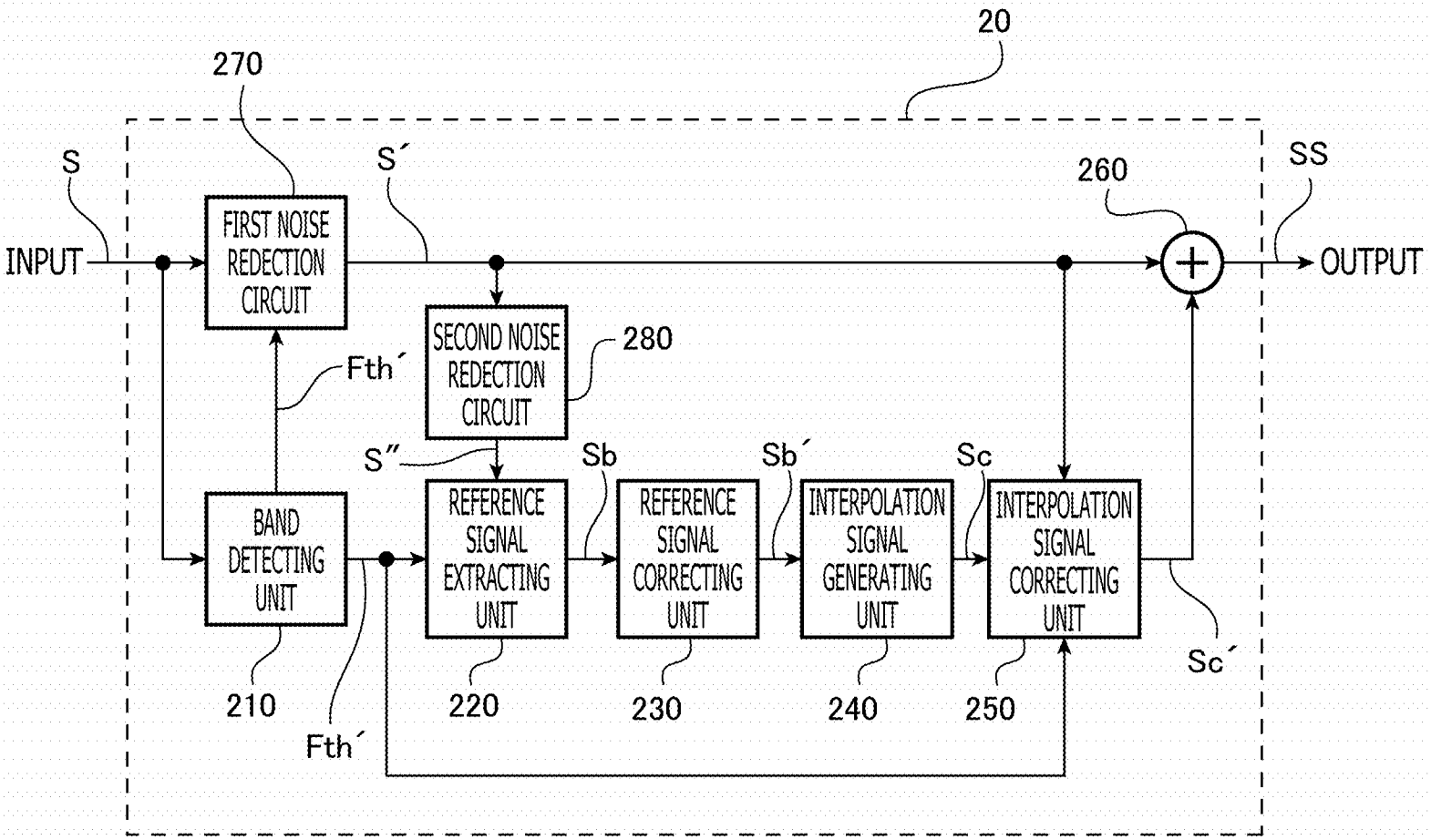
FIG. 2 is a block diagram illustrating a configuration of a high band interpolating unit provided in the sound processing device according to the embodiment of the invention.

FIG. 2 is a block diagram illustrating a configuration of the high band interpolating unit 20. As shown in FIG. 2, the high band interpolating unit 20 includes a band detecting unit 210, a reference signal extracting unit 220, a reference signal correcting unit 230, an interpolation signal generating unit 240, an interpolation signal correcting unit 250, a addition unit 260, a first noise reduction circuit 270, and a second noise reduction circuit 280. For convenience of explanation, in the following, reference symbols are assigned to input signals and output signals for each unit in the high band interpolating unit 20.

Figure 3:
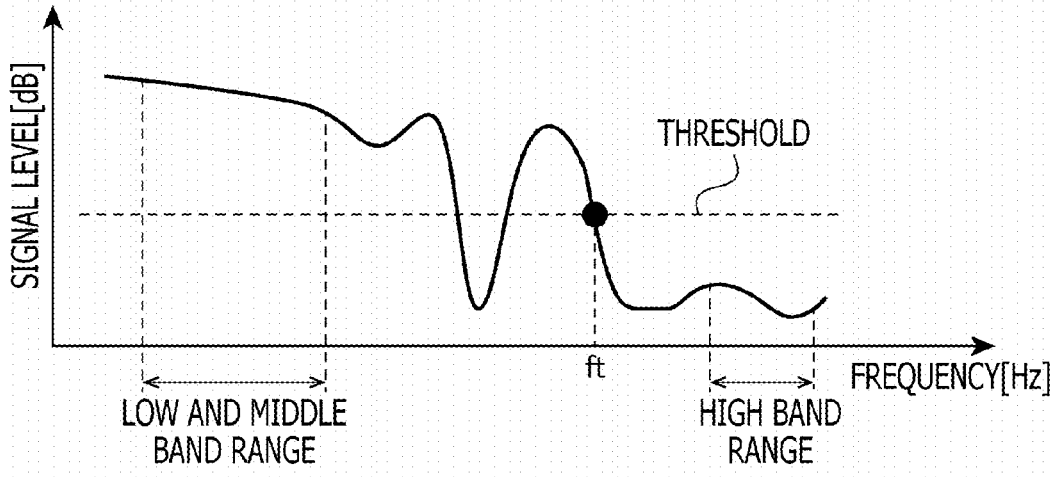
FIG. 3 is a diagram assisting explanation about operation of a band detecting unit provided in the high band interpolating unit according to the embodiment of the invention.

FIG. 3 is a diagram assisting explanation about operation of the band detecting unit 210, and shows an example of a complex spectrum S input from the FFT unit 10 to the band detecting unit 210. In FIG. 3, the vertical axis (y axis) represents the signal level (unit: dB), and the horizontal axis (x axis) represents the frequency (unit: Hz).

The band detecting unit 210 converts the complex spectrum S (a linear scale) of the audio signal input from the FFT unit 10 into a decibel scale. In order to prevent occurrence of local fluctuation on the complex spectrum S, the band detecting unit 210 smoothes the complex spectrum S converted to the decibel scale. The band detecting unit 210 calculates signal levels of a predetermined low and middle range and a predetermined high range for the smoothed complex spectrum S, and sets a threshold based on the calculated signal levels of the low and middle range and the high range. For example, as shown in FIG. 3, the threshold is in an intermediate level between the signal level (an average value) of the low and middle range and the signal level (an average value) of the high range.

The band detecting unit 210 detects frequency points lower than the threshold from the complex spectrum S (a linear scale) input from the FFT unit 10. As shown in FIG. 3, when a plurality of frequency points lower than the threshold exist, the band detecting unit 210 detects a frequency point (a frequency ft in the example of FIG. 3) on the higher band side. For convenience of explanation, in the following, a frequency detected (the frequency ft in this example) by the threshold is referred to as a "threshold frequency Fth". It should be noted that, in order to suppress generation of undesired interpolation signals, the band detecting unit 210 judges that generation of an interpolation signal is not necessary when at least one of following conditions (1) to (3) is satisfied.

(1) the detected threshold frequency Fth is lower than or equal to a predetermined frequency.

(2) the signal level of the high range is higher than or equal to a predetermined value.

(3) the difference between the signal level of the low and middle range and the signal level of the high range is lower than or equal to a predetermined value.

For the complex spectrum S for which it is judged that generation of an interpolation signal is not necessary, the high band interpolation is not performed.

Figure 4:
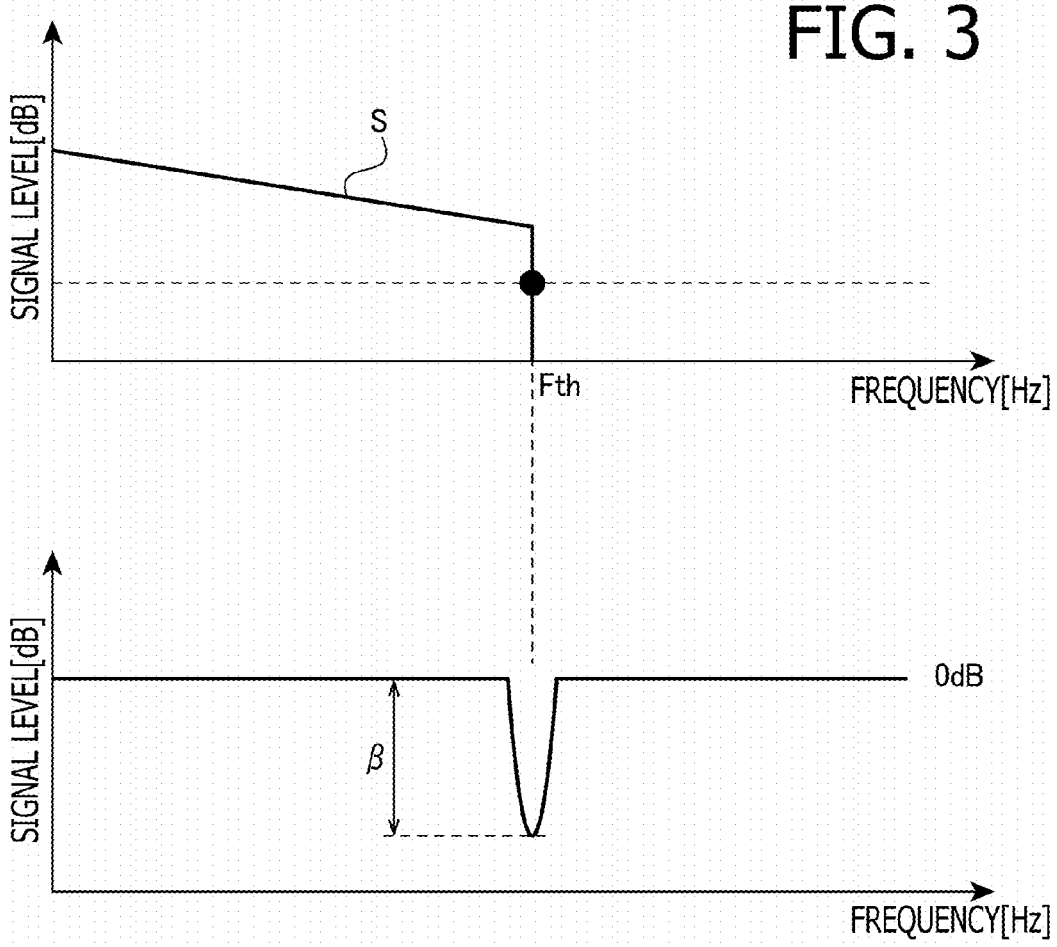
FIG. 4 illustrates, a relationship between a threshold frequency and a complex spectrum of a high compression audio signal input to the band detecting unit according to the embodiment of the invention (a diagram in an upper section), and illustrates a relationship between the frequency and a changing rate of a signal level of the high compression audio signal (a diagram in a lower section).

In an upper section of FIG. 4, a relationship between the threshold frequency Fth and the complex spectrum S of the high compression audio signal input to the band detecting unit 210 from the FFT unit 10 is illustrated. In a lower section of FIG. 4, a relationship between the frequency and a changing rate β of the signal level of the high compression audio signal is illustrated, in an upper section of FIG. 5, a relationship between the threshold frequency Fth and the complex spectrum S of the high quality audio signal input to the band detecting unit 210 from the FFT unit 10 is illustrated. In a lower section of FIG. 5, a relationship between the frequency and a changing rate β of the signal level of the high quality audio signal is illustrated. The changing rate β is obtained by differentiating the complex spectrum S through use of a high pass filter. In each of the graphs shown in the upper sections of FIGS. 4 and 5, the vertical axis (y axis) represents the signal level (unit: dB), and the horizontal axis (x axis) represents the frequency (unit: Hz). Furthermore, in each of the graphs shown in the lower sections of FIGS. 4 and 5, the vertical axis (y axis) represents the changing rate (unit: dB) of the signal level, and the horizontal axis (x axis) represents the frequency (unit: Hz).

Regarding the high compression audio signal, in order to reduce an amount of information, a high band of the high compression signal around the threshold frequency Fth is cut significantly (see the upper filed in FIG. 4), and the changing rate β of the signal level around the threshold frequency Fth is large (see the lower section in FIG. 4). On the other band, regarding the high quality audio signal, the signal level around the threshold frequency Fth is in a form of a relatively moderate frequency slope (see the upper section in FIG. 5), and the changing rate β of the signal level around the threshold frequency Fth is small (see the lower section in FIG. 5).

To the reference signal extracting unit 220, the complex spectrum S of which noise is removed via the first noise reduction circuit 270 and the second noise reduction circuit 280 is input. For convenience of explanation, in the following, the complex spectrum S after noise reduction by the first noise reduction circuit 270 is assigned a reference symbol S', and the complex spectrum S' after noise reduction by the second noise reduction circuit 280 is assigned a reference symbol. S. Details about noise reduction processes by the first noise reduction circuit 270 and the second noise reduction circuit 280 are explained later. Furthermore, to the reference signal extracting unit 220, information concerning a post-offset frequency Fth' is input from the band detecting unit 210. Details about the post-offset frequency Fth' is also explained later.

Figure 6:
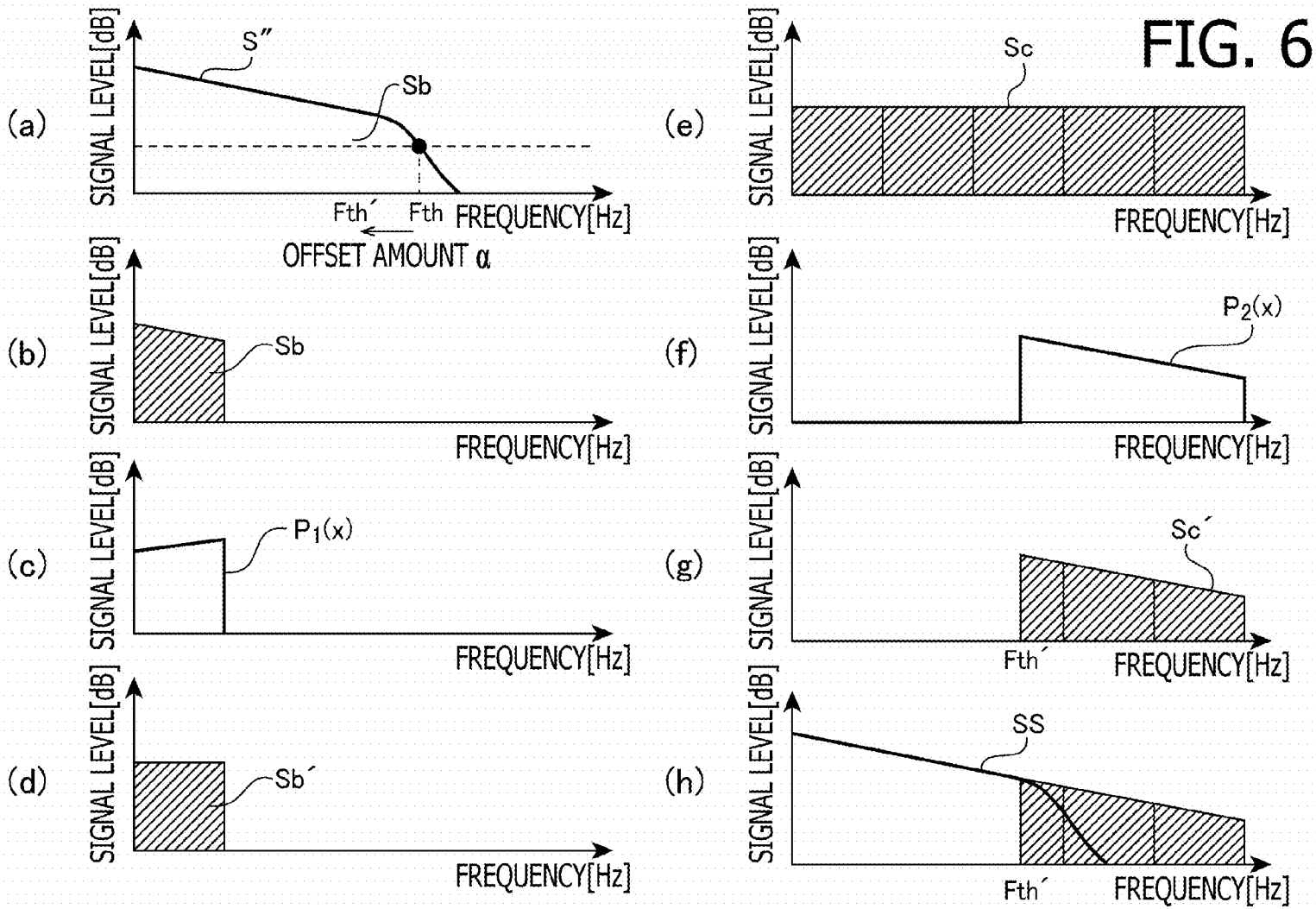
FIGS. 6(*a*) to 6(*h*) show operating waveforms (FIGS. 6(*a*) to 6(*h*)) for explaining a series of processes executed until high band interpolation is performed for a complex spectrum input to a reference signal extracting unit provided in the high band interpolating unit according to the embodiment of the invention.

FIGS. 6(*a*) to 6(*h*) show operating waveforms for explaining a series of processes executed until the high band interpolation is performed for the complex spectrum S" input to the reference signal extracting unit 220. In each of FIGS. 6(*a*) to 6(*h*), the vertical axis (y axis) represents the signal level (unit: db), and the horizontal axis (x axis) represents the frequency (unit: Hz).

Let us consider a case where the reference signal extracting unit 220 extracts a reference signal Sb from the complex spectrum S" based on information concerning the threshold frequency Fth. In this case, for example, a complex spectrum in a range extending from the threshold frequency Fth to a lower frequency side by n % (0<n) is extracted as the reference signal Sb from the whole complex spectrum S. Therefore, there is a possibility that the reference signal Sb does not have an appropriate signal level due to the effect of a frequency slope of the complex spectrum S" around the threshold frequency Fth set when the threshold frequency Fth is detected. In particular, when the reference signal Sb is a high quality audio signal, deterioration of quality by the frequency slope around the threshold frequency Fth is large, and therefore the reference signal Sb may not have an appropriate signal level.

For this reason, the band detecting unit 210 applies an offset amount α according to the frequency slope around the threshold frequency Fth to the detected threshold frequency Fth, and outputs the threshold frequency Fth after the offset (the post-offset frequency Fth') to the reference signal extracting unit 220. The reference signal extracting unit 220 extracts, from the whole complex spectrum S", a complex spectrum in a range extending to a lower frequency side by n % from the offset frequency Fth' as the reference signal Sb (see FIG. 6(*a*)). As a result, deterioration of quality of the reference signal Sb due to the frequency slope around the threshold frequency Fth is prevented.

Figure 7:
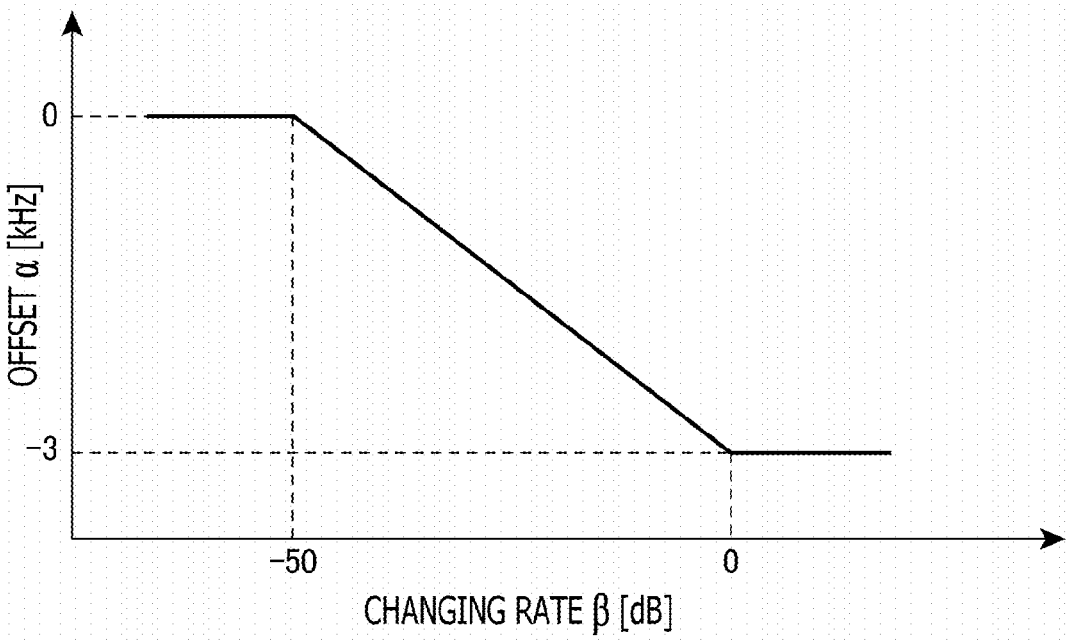
FIG. 7 illustrates a relationship between an offset amount and a changing rate of a signal level at the threshold frequency or around the threshold frequency.

FIG. 7 illustrates a relationship between the offset amount α and a changing rate β of the signal level around the threshold frequency Fth (or at the threshold frequency Fth). It should be noted that the changing rate β around the threshold frequency Fth is, for example, an average within a predetermined range including the threshold frequency Fth. In FIG. 7, the vertical axis (y axis) represents the offset amount α (unit: Hz), and the horizontal axis (x axis) represents the changing rate β (unit: dB) of the signal level. As shown in FIG. 7, the offset amount α changes in a range of 0 Hz to −3 kHz within respect to a range of −50 dB to 0 dB of the changing rate β of the signal level. The absolute value of the offset amount α becomes smaller as the changing rate β becomes larger (as the frequency slope becomes steeper), and the absolute value of the offset amount α becomes larger as the changing rate β becomes smaller (as the frequency slope becomes more moderate).

Specifically, in the example of the high compression audio signal shown in FIG. 4, the changing rate β of the signal level is large (the frequency slope is steep), and deterioration of quality of the reference signal. Sb due to the frequency slope around the threshold frequency Fth is substantially zero. Therefore, the offset amount α is zero. Accordingly, the reference signal extracting unit 220 extracts, as the reference signal Sb, a complex spectrum in a rage extending to a lower frequency side by n % from the post-offset frequency Fth' equal to the threshold frequency TU.

Figure 5:
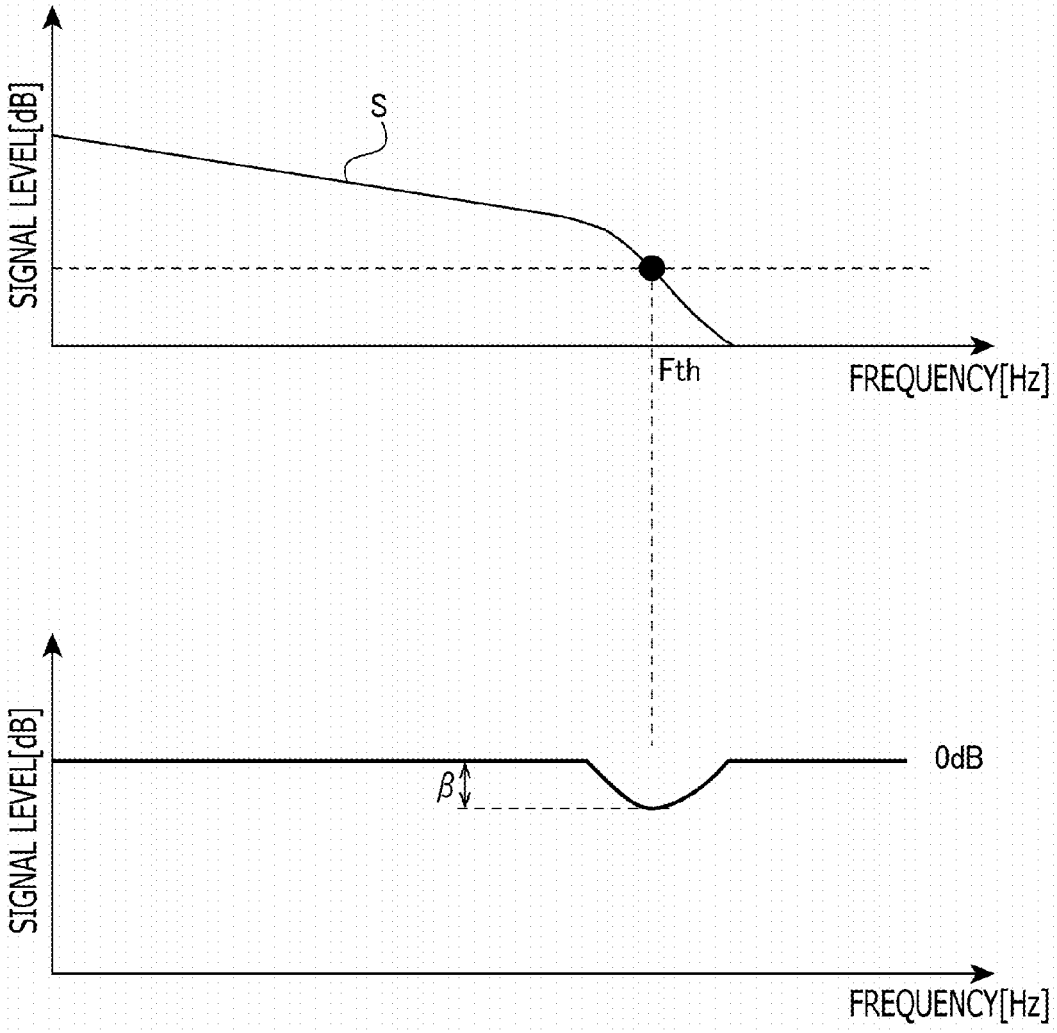
FIG. 5 illustrates a relationship between a threshold frequency and a complex spectrum of a high compression audio signal input to the band detecting unit according to the embodiment of the invention (a diagram in an upper section), and illustrates a relationship between the frequency and a changing rate of a signal level of the high compression audio signal (a diagram in a lower section).

On the other band, in the example of the high quality audio signal shown in FIG. 5, the changing rate β of the signal level is small (the frequency slope is moderate), and deterioration of quality of the reference signal Sb due to the frequency slope around the threshold frequency Fth is large. Therefore, the offset amount α is −3 kHz. Accordingly, the reference signal extracting unit 220 extracts, as the reference signal Sb, a complex spectrum in a range extending to a lower frequency side by n % from the post-offset threshold frequency Fth' which is lower by 3 kHz from the threshold frequency Fth. As a result, as shown in FIG. 6(*a*), the effect of frequency slope around the threshold frequency Fth is eliminated and the level of the reference signal Sb becomes a sufficient (suitable) signal level.

There is a problem that, when the high band interpolation is performed by an interpolation signal generated based on a signal of a voice band (e.g., natural voice), the sound quality of the signal deteriorates by changing to the sound quality which tends to give uncomfortable feeling in regard to auditory feeling. By contrast, according to the embodiment, the narrower the complex spectrum S" becomes, the narrower the frequency band of the reference signal Sb becomes. Therefore, extraction of the voice band which would cause deterioration of the sound quality can be suppressed.

The reference signal extracting unit 220 shifts the frequency of the reference signal Sb extracted from the complex spectrum S" to a lower frequency side (a DC side) (see FIG. 6(*b*)), and outputs, to the reference signal correcting unit 230, the reference signal Sb of which frequency has been shifted.

The reference signal correcting unit 231) converts the reference signal Sb (a linear scale) input from the reference signal extracting unit 220 to a decibel scale, and detects a frequency slope by a linear regression analysis with respect to the reference signal Sb converted into the decibel scale. The reference signal correcting unit 230 calculates an inverse property (a weighting amount for each frequency with respect to the reference signal Sb) of the frequency slope detected by the linear regression analysis. Specifically, when the weighting amount for each frequency with respect to the reference signal Sb is defined as $p_1(x)$, a sampling point of FFT in the frequency domain on the horizontal axis (x axis) is defined as x, the value of the frequency slope of the reference signal Sb detected by the linear regression analysis is defined as $\alpha_1$, ½ of the sample number of the FFT corresponding to the frequency band of the reference signal Sb is defined as $\beta_1$, the reference signal correcting unit 230 calculates the inverse property of the frequency slope (the weighting amount $p_1(x)$ for each frequency with respect to the reference signal Sb) by a following expression (1).

$$p_1(x)=-\alpha_1 x+\beta_1 \quad \text{(Expression (1))}$$

As shown in FIG. 6(*c*), the weighting amount p1(*x*) for each frequency, with respect to the reference signal Sb is obtained in the decibel scale. The reference signal correcting unit 230 converts the weighting amount $p_1(x)$ obtained in the decibel scale into the linear scale. The reference signal correcting unit 230 multiplies the weighting amount $p_1(x)$ converted into the linear scale and the reference signal Sb (linear scale) input from the reference signal extracting unit 220 together to correct the reference signal Sb. Specifically, the reference signal Sb is corrected to a signal (a reference signal Sb') having a flat frequency property (see FIG. 6(*d*)).

To the interpolation signal generating unit 240, the reference signal Sb' corrected by the reference signal correcting unit 230 is input. The interpolation signal generating unit 240 generates an interpolation signal Sc including a high band, by expanding the reference signal Sb' to a frequency band higher than the threshold frequency Fth (in other words, by copying the reference signal Sb' to generate a plurality of reference signals Sb' and by arranging the plurality of copied reference signals Sb' to reach a frequency band higher than the threshold frequency Fth) (see FIG. 6(*e*)). A range in which the frequency signal Sb' is expanded includes, for example, a band close to the upper limit of the audible band or a band exceeding the upper limit of the audible band.

Figure 8:
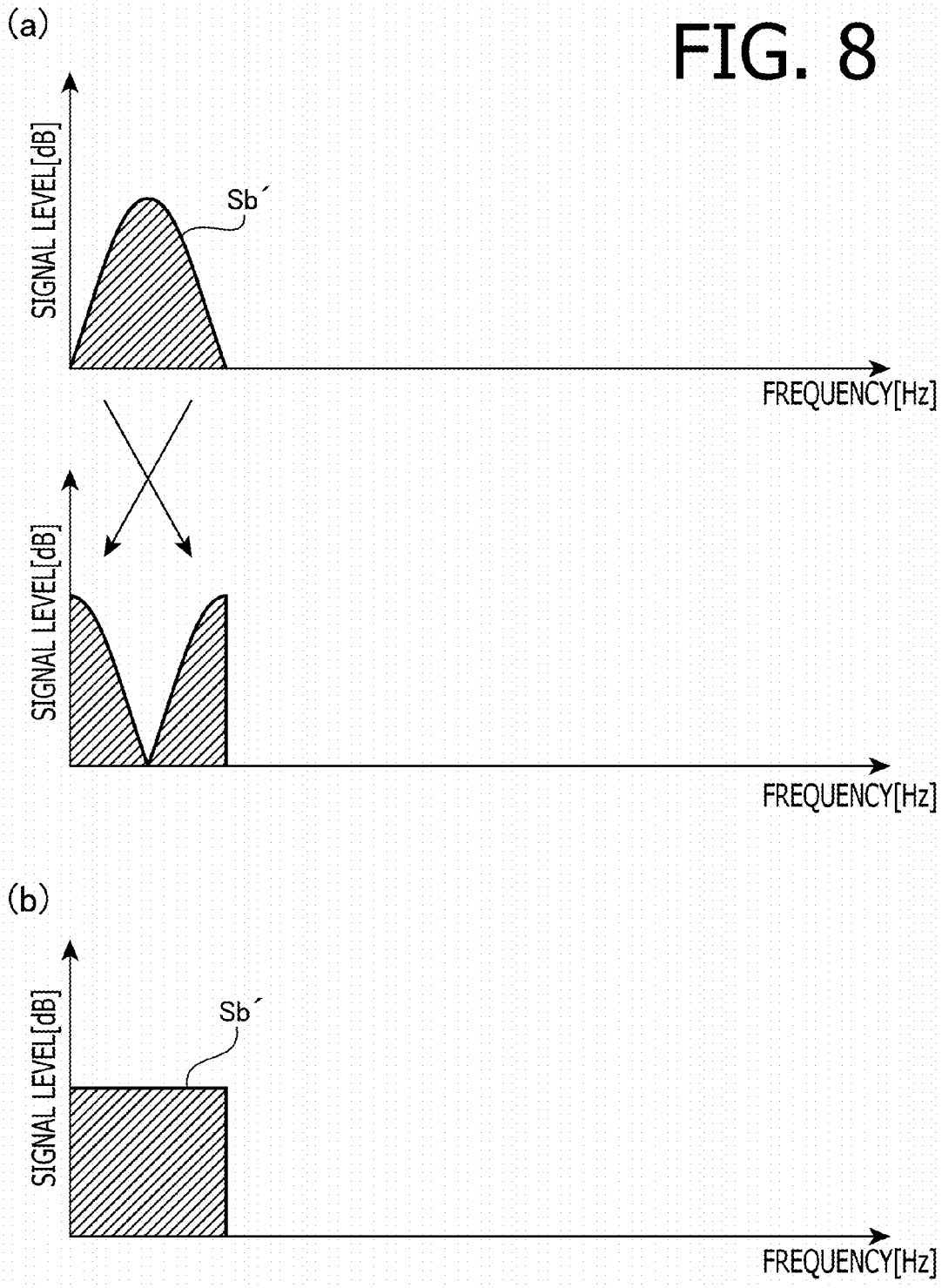
FIGS. 8(*a*) and 8(*b*) illustrate operating waveforms (FIGS. 8(*a*) and 8(*b*)) for explaining operation of an interpolation signal generating unit provided in the high band interpolating unit according to the embodiment of the invention.

FIGS. 8(*a*) and 8(*b*) illustrate operating waveforms for explaining the operation of the interpolation signal generating unit 240. Strictly speaking, the reference signal Sb' corrected by the interpolation signal correcting unit 230 does not have a flat frequency property. Therefore, when the reference signal Sb' is copied to a plurality of bands in the interpolation signal generating unit 240, inter-band interference is caused due to the abrupt change of amplitude and phase between the copied reference signals Sb'. As a result, pre-echo in which a signal is precedently output along the time axis relative to the true interpolation signal Sc is caused. Therefore, as shown in the upper section in FIG. 8(*a*), the interpolation signal generating unit 240 executes weighting of the frequency property by multiplying the reference signal Sb' by a predetermined window function and executes the overlapping process. As a result, the signal level difference and the phase difference between the bands is reduced and the inter-band interference is reduced.

It should be noted that when the reference signal Sb' shown in the upper section in FIG. 8(*a*) is copied to a plurality of bands without change, the interpolation signal would have ripples. Therefore, the interpolation signal generating, unit 240 divides the reference signal Sb' into two parts with respect to a peak of the reference signal Sb', and replaces the divided signal on the high frequency side and the divided signal on the lower frequency side with each other (see the lower section in FIG. 8(*a*)). Then, the interpolation signal generating unit 240 synthesizes the reference signal. Sb' after weighting by the window function (see the upper section in FIG. 8(*a*)) and the reference signal after the replacing (see the lower section in FIG. 8(*a*)), and performs the overlapping process between the bands. As a result, the reference signal Sb' (see FIG. 8(*b*)) having a flatter frequency property is obtained. Regarding the thus obtained reference signal Sb', even when the reference signal Sb' is copied to a plurality of bands, the inter-band interference is not caused and no pre-echo is generated. That is, the interpolation signal Sc having a flat frequency property is obtained.

To the interpolation signal correcting unit 250, the interpolation signal Sc generated in the interpolation signal generating unit 240 is input. Furthermore, to the interpolation signal correcting unit 250, the complex spectrum S' is input from the first noise reduction circuit 270 and the information concerning the post-offset frequency Fth' is input from the band detecting unit 210.

The interpolation signal correcting unit 250 converts the complex spectrum S' (linear scale) input from the first noise reduction circuit 270 into a decibel scale, and detects, by linear regression analysis, a frequency slope of the complex spectrum S' converted into the decibel scale. It should be noted that, when the interpolation signal correcting unit 250 detects the frequency slope, the interpolation signal correcting unit 250 does not use information concerning a higher band side than the post-offset frequency Fth'. A range of the regression analysis may be arbitrarily set; however, in order to smoothly connect a higher baud side of an audio signal with the interpolation signal, typically the range of the regression analysis corresponds to a predetermined frequency band excepting a lower band component. The interpolation signal correcting unit 250 calculates, for each frequency, a weighting amount in accordance with the frequency band corresponding to the detected frequency slope and the range of the regression analysis. Specifically, when the weighting amount of each frequency with respect to the interpolation signal Sc is defined as $p_2(x)$, a sampling point on the horizontal axis (x axis) of FET in the frequency domain is defined as x, the sampling length of FFT is defined as s, the upper limit frequency of the range of the regression analysis is defined as b, the sample length of FFT is defined as s, a value of the frequency slope in the frequency band corresponding to the range of the regression analysis is defined as $\beta_2$, and a predetermined correction coefficient is defined as k, the interpolation signal correcting unit 250 calculates the weighting amount p2(*x*) of each frequency with respect to the interpolation signal Se by the following expression (2).

$$p_2(x)=-\alpha' x+\beta_2 \quad \text{(Expression (2))}$$

where $\alpha'=\alpha_2-(1-(b/s))/k$ $\beta_2=-a'b$ when $x<b$, $p_2(x)=-\infty$ As shown in FIG. 6(*f*), the weighting amount $p_2(x)$ of each frequency with respect to the interpolation signal Sc is obtained in the decibel scale. The interpolation signal correcting unit 250 converts the weighting amount $p_2(x)$ in the decibel scale into a linear scale. The interpolation signal correcting unit 250 corrects the interpolation signal Sc by multiplying together the weighting amount $p_2(x)$ converted into the linear scale and the interpolation signal Sc (linear scale) generated in the interpolation generating unit 240. As shown as an example in FIG. 6(*g*), the interpolation signal Sc' after correction is a signal on a high band side relative to the post-offset frequency Fth' and has a property of attenuating toward a higher frequency side.

To the addition unit 260, the complex spectrum S' is input from the FFT unit 10 via the first noise reduction circuit 270, and the interpolation signal Sc' is input from the interpolation signal correcting unit 250. The complex spectrum S' is a complex spectrum of an audio signal of which a high band component is significantly cut or an audio signal of which the amount of information concerning a high band component is small. The interpolation 3C) signal Sc' is a complex spectrum concerning a frequency region higher than the frequency band of the audio signal. The addition unit 260 generates a complex spectrum SS (see FIG. 6(*h*)) of the audio signal of which the high band is interpolated, by synthesizing the complex spectrum. S' and the interpolation signal Sc', and outputs the generated complex spectrum SS of the audio signal to the IFFT unit 30.

Thus, according to the embodiment, the reference signal Sb is extracted from the complex spectrum S" based on the post-offset frequency Fth offset in accordance with the frequency slope around the threshold frequency Fth. As a result, deterioration of quality of the reference signal Sb due to the frequency slope is suppressed, and therefore it becomes possible to generate the interpolation signal Sc' having high quality. Accordingly, regardless of a frequency property of an audio signal input to the FFT unit 10, it becomes possible to perform, for an audio signal, the high band interpolation by which a spectrum having a natural property of attenuating in continuous change is provided, and enhancement of sound quality in terms of auditory feeling can be achieved.

Furthermore, since, in the embodiment, the overlapping process and the weighting by the window function is performed for the reference signal Sb', occurrence of pre-echo by the inter-band interference can be suppressed. That is, since the pre-echo which is caused as a side effect by the high band interpolation is suppressed, enhancement of sound quality in terms of auditory feeling can be achieved.

Figure 9:
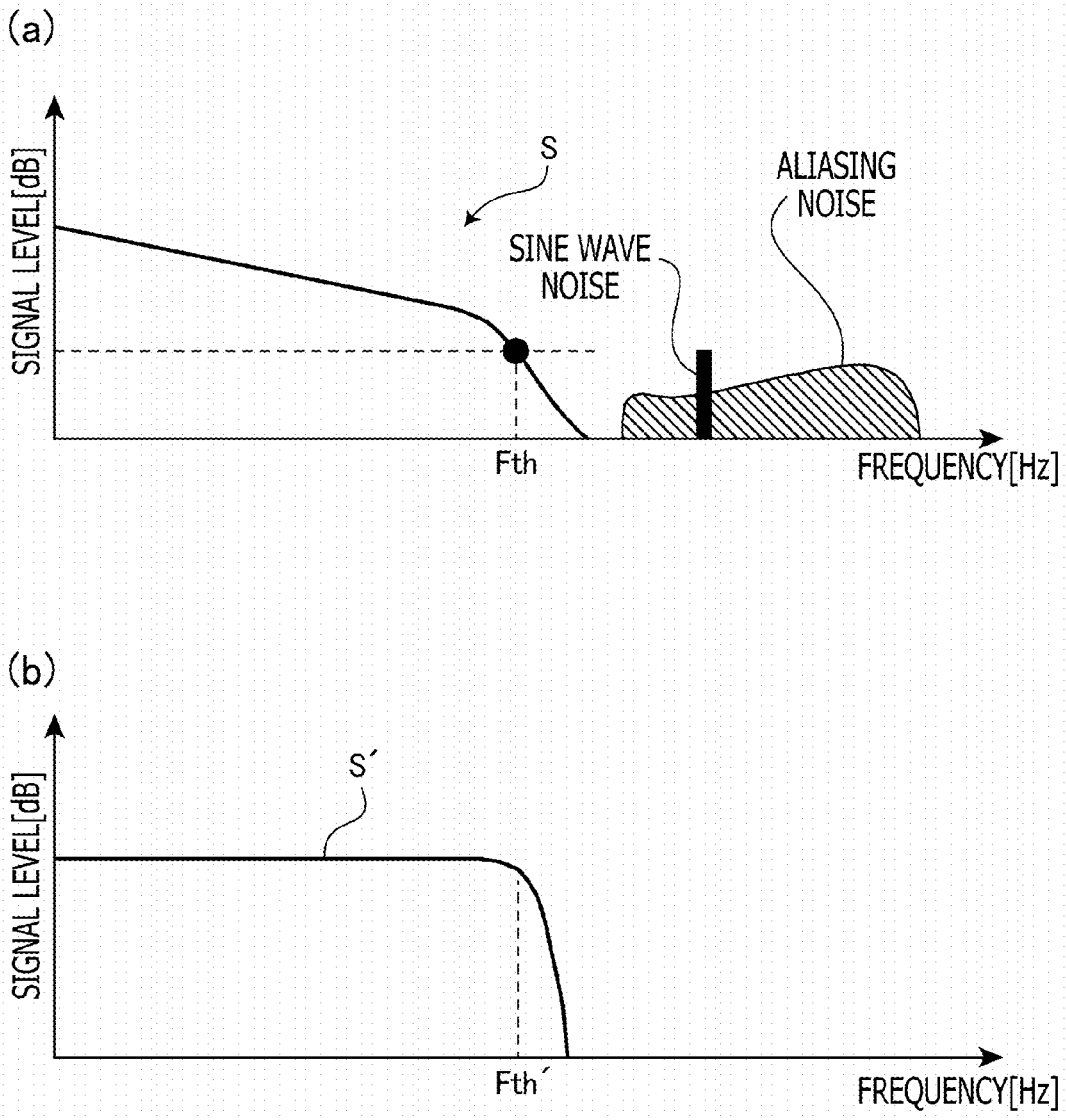
FIGS. 9(*a*) and 9(*h*) are explanatory illustrations (FIGS. 9(*a*) and 9(*b*)) for explaining a noise removing process by a first noise reduction circuit provided in the high band interpolating unit according to the embodiment of the invention.

In the meantime, there is a case where aliasing noise (folding noise) caused by conversion of a sampling frequency and undesired sine wave noise are mixed into an audio signal input from a sound source in a band exceeding the threshold frequency Fth, depending on recording environments of the sound source or effects of audio devices. FIG. 9(*a*) shows an example of a complex spectrum S of an audio signal into which noise of this type is mixed. Since the sine wave noise and the aliasing noise exemplified in FIG. 9(*a*) cause deterioration of sound quality, it is desirable to eliminate such noise.

For this reason, the first noise reduction circuit 270 includes a low pass filter of which cut-off frequency is variable depending on the threshold frequency Fth. Specifically, the first noise reduction circuit 270 filters the complex spectrum S input from the FFT unit 10 based on the information concerning the threshold frequency Fth input from the band detecting unit 210, and outputs the filtered complex spectrum S' to rear stage circuit.

FIG. 9(*b*) shows the complex spectrum S' obtained by filtering the complex spectrum S exemplified in FIG. 9(*a*) by the threshold frequency Fth. As shown in FIG. 9(*b*), in the complex spectrum S', the sine wave noise and the aliasing noise are removed by the first noise reduction circuit 270. As a result, deterioration of sound quality by the sine wave noise and the aliasing noise can be suppressed.

Furthermore, there is a case where undesired sine wave noise is mixed, on a lower band side with respect to the threshold frequency Fth, into an audio signal input from a sound source due to recording environments of the sound source or effects of audio devices. As an example, FIG. 10(*a*) shows the complex spectrum S of the audio signal into which noise of this type is mixed.

Figure 10:
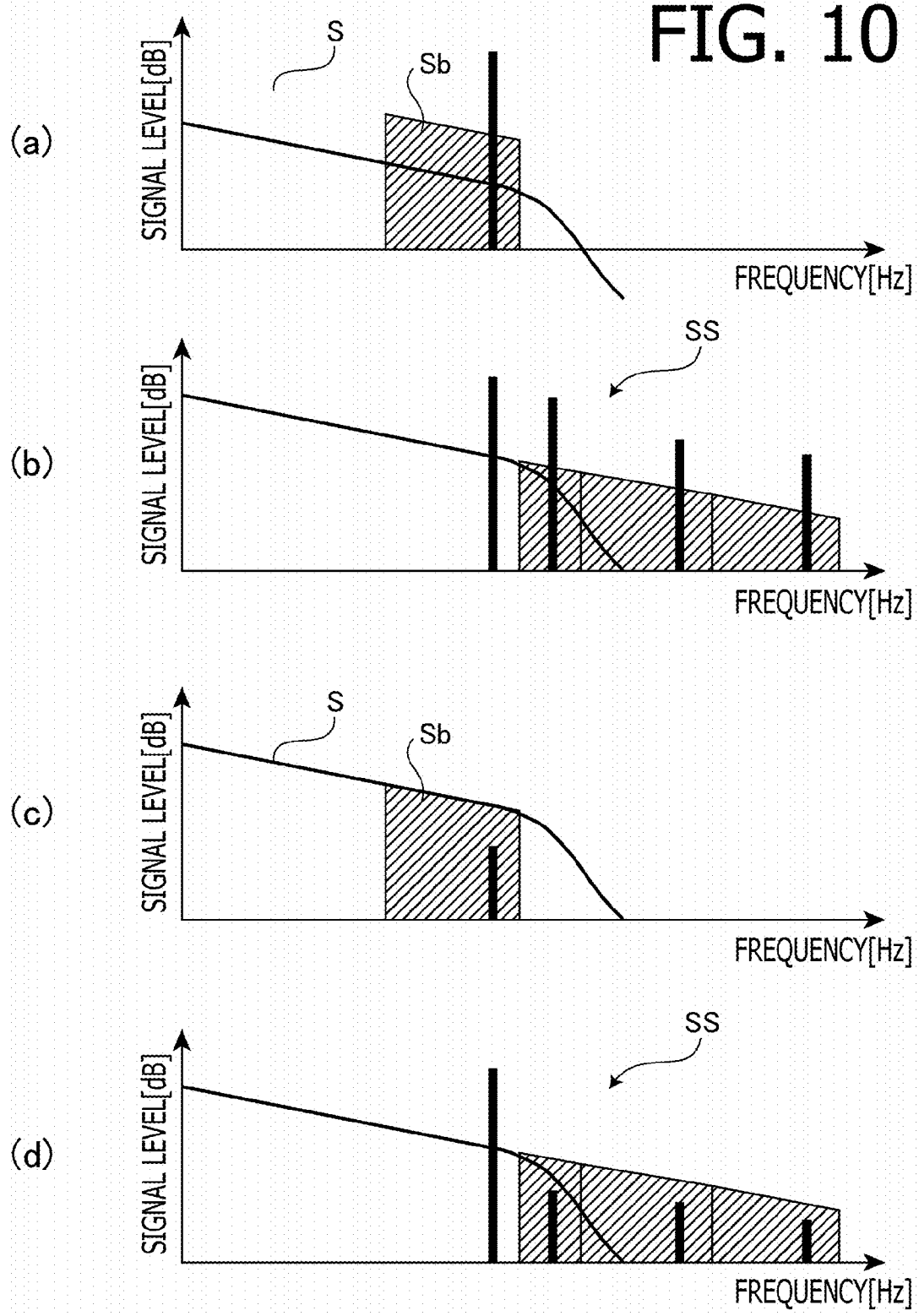
FIGS. 10(*a*) to 10(*d*) are explanatory illustrations (FIGS. 10(*a*) to 10(*d*)) for explaining a noise removing process by a second noise reduction circuit provided in the high band interpolating unit according to the embodiment of the invention.

In the example shown in FIG. 10(*a*), noise is mixed into a band extracted as the reference signal Sb. When the high band interpolation is performed based on the reference signal Sb into which such noise is mixed, noises, the number of which is increased depending IC) on the number of copying processes for the reference signal Sb', are superimposed onto the audio signal which has been subjected to the high band interpolation as shown in FIG. 10(*b*).

For this reason, in this embodiment, the noise mixed into the reference signal Sb is reduced in advance on a front stage of the copying process of the reference signal Sb' to the plurality of bands. Specifically, the second noise reduction circuit 280 converts the complex spectrum S', which has been input thereto a plurality of times for respective STFT and which ranges from a low band to a high band, into an amplitude spectrum and a phase spectrum. The second noise reduction circuit 280 suppresses, for each of the converted amplitude components, a constant component (i.e., a DC component and a fluctuating component around DC) by the filtering process. The second noise reduction circuit 280 re-converts the suppressed amplitude spectrum and the phase spectrum into the complex spectrum. As shown in FIG. 10(*c*), the resultant complex spectrum S" is such that only a constant component, such as a sine wave, is suppressed. When the high band interpolation is performed by generating the interpolation signal based on the reference, signal Sb of which a sine-wave and the like have been suppressed, increase of noise during the copying process of the reference signal Sb' can be suppressed as shown in FIG. 10(*d*). As a result, deterioration of sound quality by the sine-wave noise can be suppressed.

(Example of Operating Parameter)

Hereafter, examples of operating parameters of the sound processing device 1 according to the embodiment are shown. The operating parameters exemplified herein are applied to cases 1 to 4 described below. It should be noted that an audio signal processed in each of the cases 1 to 4 is a high quality audio signal.

(FTT Unit 10/IFFT Unit 30)
Sampling Frequency 96 kHz
Sampling length: 5,192 samples
Window function: Hanning
Overlap length: 75%
(Band detecting unit 210)
Minimum control frequency: 7 kHz
Low and middle band range: 2 kHz-6 kHz
High band range 46 kHz-48 kHz
High band level judgment: −40 dB
Signal level difference: 30 dB
Threshold: 0.5
Standardized cutoff frequency of primary high-pass filler: 0.005
(Reference signal extracting unit 220)
Reference band width: 6 kHz
(Interpolation signal generating unit 240)
Window function: Hanning (Interpolation signal correcting unit 250)

Lower limit frequency 500 Hz

Correction coefficient k: 0.01

(First noise reduction circuit 270)

Variable low-pass filter responsive to the threshold frequency Fth (Second noise reduction circuit 280)

Standardized cutoff frequency of primary high-pass filter: 0.01

"Sampling frequency (=96 kHz)" indicates sampling points of FFT, converted into the frequency, in the frequency domain by STFT. "Minimum control frequency (=0.7 kHz)" indicates that the high band interpolation is not performed when the threshold frequency Fth detected by the band detecting unit 210 is smaller than 7 kHz, "High band level judgment (=−40 dB)" indicates that the high band interpolation is not performed when the signal level in the high band is higher than or equal to −40 dB. "Signal level difference (=30 dB)" indicates that the high band interpolation is not performed when the signal level difference between the low and middle band range and the high band range is smaller than or equal to 30 dB. "Threshold (=0.5)" indicates that the threshold for detecting the threshold frequency Fth is a middle value between the signal level (an average value) of the low and middle band range and the signal level (an average value) of the band high range. "Standardized cutoff frequency of primary high-pass filter" of the band detecting unit 210 is a value, set when the changing rate β is detected. "Reference band width (=6 kHz)" is a band width of the reference signal Sb corresponding to the "Minimum control frequency (=7 kHz)". "Lower limit frequency (=500 Hz)" indicates the lower limit of a range of regression analysis by the interpolation signal correcting unit 250 (i.e., a region lower than 500 Hz is not included in the range of the regression analysis).

(Case 1)

Figure 11:
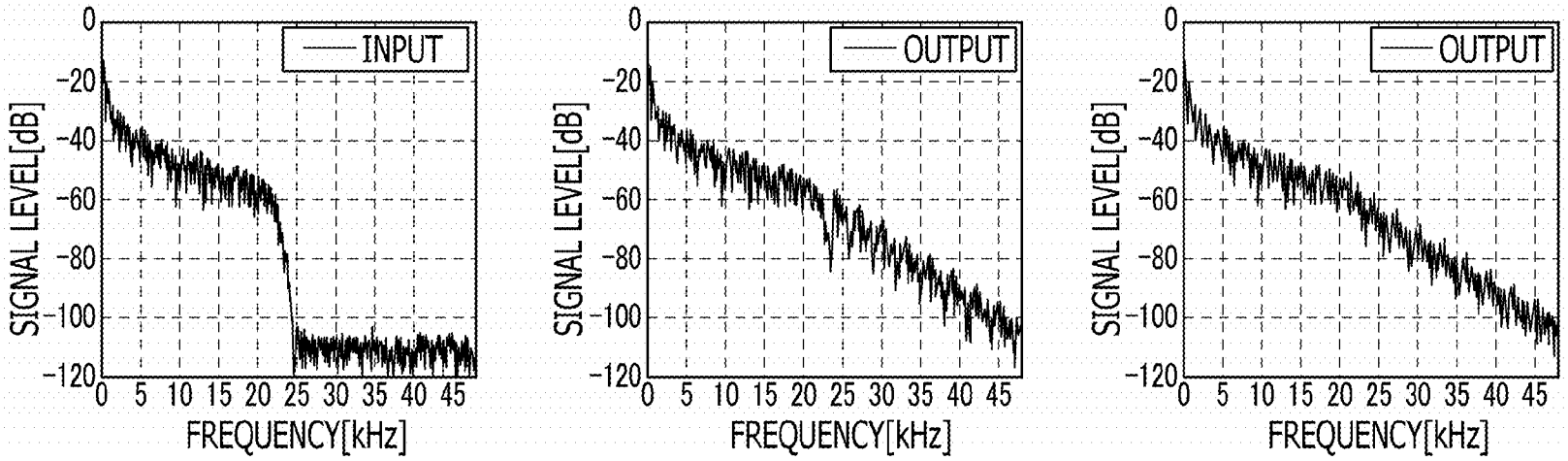
FIGS. 11(*a*) to 11(*c*) are explanatory illustrations (FIGS. 11(*a*) to 11(*c*)) of case 1 for explaining advantageous effects attained by introducing an offsetting process for the threshold frequency according to a frequency slope in the embodiment of the invention.

FIGS. 11(*a*) to 11(*c*) are explanatory illustrations for explaining the case 1. In each of FIGS. 11(*a*) to 11(*c*), the vertical axis (y axis) represents the signal level (unit: dB), and the horizontal axis (x axis) represents the frequency (unit: kHz). In the case 1, the advantageous effects attained by introducing the offsetting process for the threshold frequency Fth according to the frequency slope is explained.

FIG. 11(*a*) shows a complex spectrum S of an audio signal input to the high band interpolating unit 20. Since the complex spectrum S shown in FIG. 11(*a*) is a spectrum of a high quality audio signal, the frequency slope (around 22 kHz to 25 kHz) on the high band side is not steep but is relatively moderate.

Each of FIGS. 11(*h*) and 11(*c*) shows an output (the complex spectrum SS) with respect to the input (the complex spectrum S) shown in FIG. 11(*a*). FIG. 11(*h*) shows an output provided when the offsetting process for the threshold frequency Fth according to the frequency slope is not performed. FIG. 11(*e*) shows an output provided when the offsetting process for the threshold frequency Fth according to the frequency slope is performed.

As shown in FIG. 11(*b*), when the offsetting process for the threshold frequency Fth according to the frequency slope is not performed, the complex spectrum S' is not smoothly connected to the interpolation signal Sc' in the frequency domain (a gap is caused around 22 kHz to 25 kHz), and attenuation toward the interpolation region (the high band) becomes unnatural. In addition, since the reference signal Sb does not have a sufficient (appropriate) signal level, the attenuation in the interpolation region loses continuity and becomes unnatural.

By contrast, as shown in FIG. 11(*c*), when the offsetting process for the threshold frequency according to the frequency slope is performed, the complex spectrum S' is smoothly connected to the interpolation signal Sc' in the frequency domain, and the attenuation toward the interpolation region (the high band) becomes natural. In addition, since the reference signal Sb has a sufficient (appropriate) signal level, the attenuation in the interpolation region becomes continuous and natural.

(Case 2)

Figure 12:
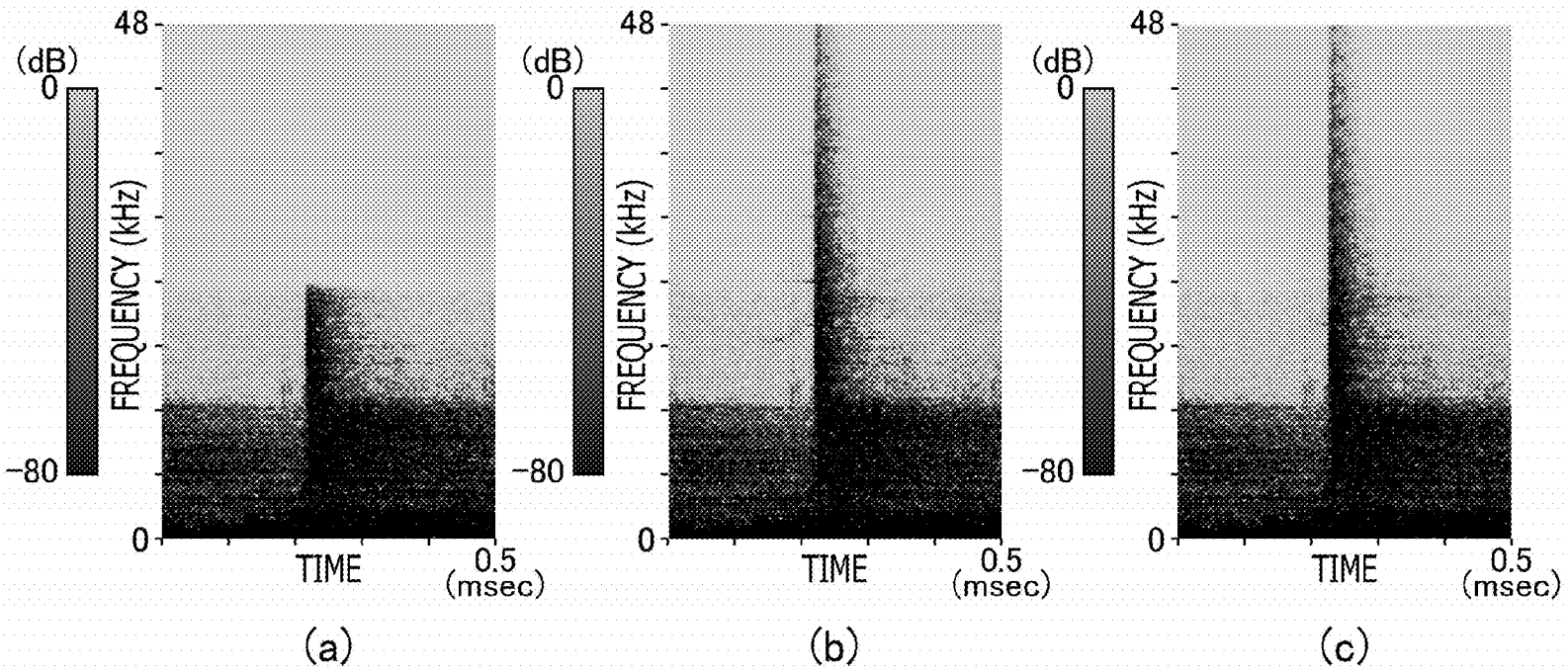
FIGS. 12(*a*) to 12(*c*) are explanatory illustrations (FIGS. 12(*a*) to 12(*c*)) of case 2 for explaining advantageous effects attained by introducing weighting by a window function and an overlapping process with respect to a reference signal in the embodiment of the invention.

FIGS. 12(*a*) to 12(*c*) are explanatory illustrations (spectrograms) for explaining the case 2. In each of FIGS. 12(*a*) to 12(*c*), the vertical axis (y axis) represents the frequency (unit: kHz), and the horizontal axis (x axis) represents time (or sample number) (unit: msec), shades of a color represent power (unit: dB). In the case 2, the advantageous effects attained by introducing the weighting by a window function and the overlapping process with respect to the reference signal Sb' are explained.

FIG. 12(*a*) shows a spectrogram of an audio signal input to the sound processing device 1 in the case 2.

Each of FIGS. 12(*b*) and 12(*c*) shows an output of the sound processing device 1 with respect to the input shown in FIG. 12(*a*). FIG. 12(*b*) is an output provided when the overlapping process and the weighting by the window function with respect to the reference signal Sb are not performed in the case 2. FIG. 12(*c*) shows an output provided when the overlapping process and the weighting by the window function with respect to the reference signal Sb' are performed in the case 2.

As shown in FIG. 12(*b*), when the overlapping process and the weighting by the window function with respect to the reference signal Sb' are not performed, the pre-echo (in FIG. 12(*b*), thin line-shaped components extending along the time axis direction on a high frequency side) is caused by inter-hand interference.

By contrast, as shown in FIG. 12(*c*), when the overlapping process and the weighting by the window function with respect to the reference signal Sb' are performed, occurrence of the pre-echo by the inter-band interference is suppressed.

(Case 3)

Figure 13:
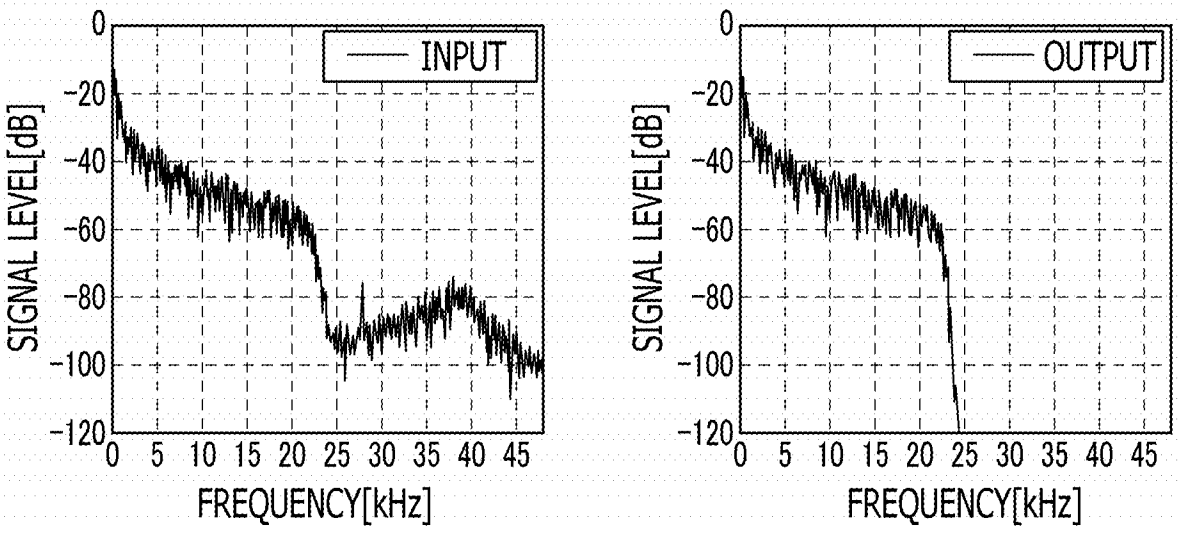
FIGS. 13(*a*) and 13(*h*) are explanatory illustrations (FIGS. 13(*a*) and 13(*b*)) of case 3 for explaining advantageous effects attained by introducing the noise removing process by the first noise reduction circuit in the embodiment of the invention.

FIGS. 13(*a*) and 13(*b*) are explanatory illustrations for explaining the case 3. In each of FIGS. 13(*a*) and 13(*h*), the vertical axis (y axis) represents the signal level (unit: dB), and the horizontal axis (x axis) represents the frequency (unit: kHz). In the case 3, advantageous effects attained by introducing the noise reduction process by the first noise reduction circuit. 270 are explained.

FIG. 13(*a*) shows a complex spectrum S of an audio signal input to the first nose reduction circuit 270 in the case 3. As shown in FIG. 13(*a*), in the case 3, sine wave noise and aliasing noise are contained in the complex spectrum S.

FIG. 13(*b*) shows the complex spectrum S' of the audio signal output by the first noise reduction circuit 270 in the case 3. As shown in FIG. 13(*b*), the sine wave noise and the aliasing noise are removed by the first noise reduction circuit 270.

(Case 4)

Figure 14:
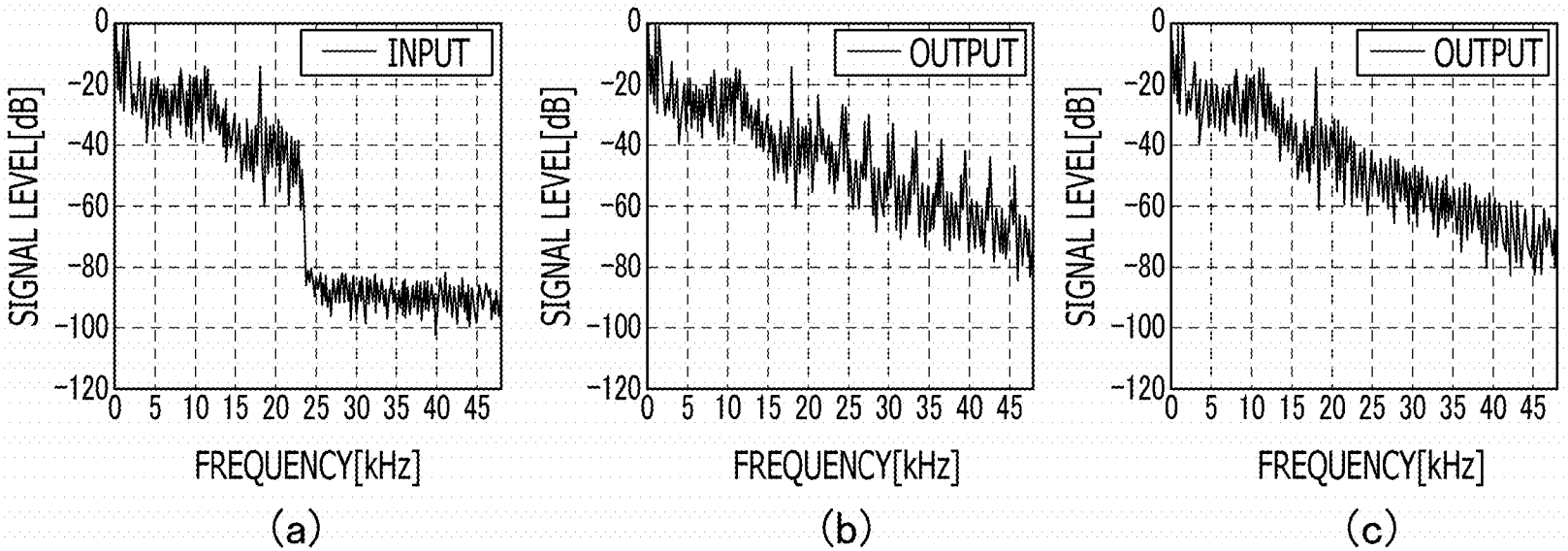
FIGS. 14(*a*) to 14(*c*) are explanatory illustrations (FIGS. 14(*a*) to 14(*c*)) of case 4 for explaining advantageous effects attained by introducing the noise removing process by the second noise reduction circuit in the embodiment of the invention.

FIGS. 14(*a*) to 14(*c*) are explanatory illustrations for explaining the case 4. In each of FIGS. 14(*a*) to 14(*c*), the vertical axis (y axis) represents the signal level (unit: dB), and the horizontal axis (x axis) represents the frequency (unit: kHz). In the case 4, advantageous effects attained by introducing the noise reduction process by the second noise reduction circuit 280 are explained.

FIG. 14(*a*) shows a complex spectrum S of an audio signal input to the high band interpolating unit 20 in the case 4. In the complex spectrum S shown in FIG. 14(*a*), sine wave noise is mixed into a band extracted as the reference signal Sb.

Each of FIGS. 14(*b*) and 14(*c*) shows an output (the complex spectrum SS) with respect to the input (the complex spectrum S) shown in FIG. 14(*a*). FIG. 14(*b*) shows an output provided when the noise reduction process by the second noise reduction circuit 280 is not performed in the case 4. FIG. 14(*c*) shows an output provided when the noise reduction process by the second noise reduction circuit 280 is performed in the case 4.

As shown in FIG. 14(*b*), when the noise reduction process by the second noise reduction circuit 280 is not performed, noises increased according to the number of copying processes of the reference signal Sb' are superimposed on the complex spectrum. SS.

By contrast, as shown in FIG. 14(*c*), when the noise reduction process by the second noise reduction circuit 280 is performed, increase of noise during the copying process of the reference signal Sb' is suppressed.

The foregoing is the explanation about the embodiment of the invention. The invention is not limited to the above described embodiment, hut can be varied in various ways within the scope of the invention. For example, embodiments of the invention include a combination of embodiments explicitly described in this specification and embodiments easily realized from the above described embodiment. For example, in the embodiment, the reference signal correcting unit 230 uses the liner regression analysis for correcting the reference signal Sb having a property of monotonously increasing or attenuating in the frequency region. However, the property of the reference signal Sb is not limited to a linear property but may be a non-linear property. Let us consider a case where the reference signal. Sb having a property of repeating increase and attenuation in the frequency domain is corrected. In this case, the reference signal correcting unit 230 calculates the inverse property by performing the regression analysis of which order is increased, and corrects the reference signal Sb by using the calculated inverse property.

What is claimed is:

1. A signal processing method, comprising:

detecting a frequency satisfying a predetermined condition from an audio signal by calculating a level of a first frequency region in the audio signal and a level of a second frequency region higher than the first frequency region in the audio signal, setting a threshold based on the calculated level of the first frequency region and the calculated level of the second frequency region, and detecting a frequency having a level lower than a level of the set threshold as the frequency satisfying the predetermined condition, the frequency satisfying the predetermined condition being a frequency at a frequency point which is on a highest frequency side of at least one frequency point having a level lower than the level of the set threshold;

giving an offset to the detected frequency in accordance with a frequency property at the detected frequency by detecting a slope property of the audio signal at the detected frequency, changing an offset amount for the detected frequency according to the detected slope property, and setting the offset amount for the detected frequency such that the offset amount becomes larger as attenuation of the audio signal at the detected frequency becomes more moderate;

extracting a signal from the audio signal based on the offset detected frequency, the extracted signal corresponding to a range extending from the detected frequency by n % toward a lower frequency side, and generating a reference signal based on the extracted signal;

generating an interpolation signal based on the generated reference signal; and performing high band interpolation by synthesizing the generated interpolation signal and the audio signal.

2. The signal processing method according to claim 1, wherein the generating the interpolation signal comprises:

making a copy of the reference signal after performing weighting by a window function and an overlapping process for the generated reference signal;

arranging side by side a plurality of reference signals increased by the copy to a frequency band higher than the detected frequency, and generating the interpolation signal by executing weighting, for each frequency component of the plurality of reference signals arranged side by side, according to a frequency property of the audio signal.

3. The signal processing method according to claim 2, further comprising reducing noise contained in the reference signal prior to making the copy of the reference signal.

4. The signal processing method according to claim 1, further comprising filtering the audio signal by a low pass filter, wherein the performing the high band interpolation comprises executing the high band interpolation for the audio signal by synthesizing the interpolation signal and the audio signal filtered by the low pass filter, and wherein, in the filtering the audio signal by the low pass filter, a cutoff frequency for the audio signal is variable according to the detected frequency.

* * * * *